US005591055A

United States Patent [19]

Ambrico et al.

[11] Patent Number: 5,591,055

[45] Date of Patent: Jan. 7, 1997

[54] CLUTCH CONTROLLED ADJUSTABLE STEERING DEVICE

[76] Inventors: Sal J. Ambrico; Kathleen A. Ambrico, both of 2590 NW. 4th St., Fort Lauderdale, Fla. 33311

[21] Appl. No.: 592,230

[22] Filed: Jan. 26, 1996

[51] Int. Cl.[6] ..... B63H 5/12

[52] U.S. Cl. ..... 440/6; 74/480 B; 440/63

[58] Field of Search ..... 440/53, 54, 55, 440/56, 49, 57, 58, 59, 60, 61, 62, 63, 6, 7; 74/480 B; 114/144 R, 162, 163

[56] References Cited

U.S. PATENT DOCUMENTS

| | | | |
|---|---|---|---|
| 2,553,204 | 5/1951 | Murphy | 440/63 |
| 3,371,641 | 3/1968 | Rohman et al. | 440/63 |
| 3,750,621 | 8/1973 | Hoyt | 440/63 |
| 3,861,348 | 1/1975 | Beierle | 440/6 |
| 4,624,206 | 11/1986 | Frye et al. | 440/6 |

*Primary Examiner*—Stephen Avila

[57] ABSTRACT

A steering device for a trolling motor attached to a boat which device includes an elongated steering arm slidably secured within a clutch mechanism wherein clutch sleeves are rotatably mounted on an internal shaft causing drag on the steering arm when moved vertically positioning the steering arm at a desired position where horizontal movement of the steering arm steers the boat.

18 Claims, 4 Drawing Sheets

CLUTCH CONTROLLED ADJUSTABLE STEERING DEVICE

FIELD OF THE INVENTION

The present invention generally relates to a steering device for electric trolling motors, and more particularly, to a clutch controlled fully adjustable steering device for conventional electric trolling motors attached to the bow or stern of the boat.

DESCRIPTION OF THE PRIOR ART

Small boats used for fishing and recreation are generally powered by electric trolling motors. The trolling motor usually has a vertical support column with a submersible motor and propeller mounted at its lower end and a small handle near its upper end of the column for steering. However, the short handle is frequently not adequate for steering the boat for a number of reasons. In many cases, auxiliary steering devices are attached in some manner to the trolling motor to provide an alternate means of steering the boat.

Many of the prior art auxiliary steering devices are attached to the trolling motor in a fixed position and the steering device cannot be raised or lowered vertically to other positions. The result is that these devices cannot be adjusted to other vertical positions to be operated by a person either standing up or sitting down or to be operated by a person's foot at a low position. Also, the length of the steering arm of the auxiliary steering device is usually set at one length and the length of the arm cannot be increased or decreased longitudinally to be operated by a person at various positions in the boat. Further, because of the fixed position of the attached steering arms of these devices, they are inadequate for steering the boat in all types of weather and surf conditions so that the auxiliary steering arm would provide drag when the handle is raised or lowered to a different position to be held firmly at that desired height position.

It is the object of the present invention to provide an adjustable steering device attached to conventional trolling motors which device having a steering arm that can be raised or lowered vertically to various positions.

It is another object of the present invention to provide an adjustable auxiliary steering device which can be operated by a person standing or sitting or by a person's foot.

It is a further object of the present invention to provide an adjustable auxiliary steering device having a steering arm which can be adjusted to various longitudinal lengths.

It is a further object of the present invention to provide an adjustable auxiliary steering device having a clutch mechanism providing drag when the steering arm is raised or lowered vertically to the desired steering height.

These and other objects will be readily evident upon a study of the following specification.

SUMMARY OF THE INVENTION

The present invention advantageously provides an adjustable clutch controlled steering device for electric trolling motors connected to the bow or stern of a boat. The present steering device includes an elongated longitudinal handle arm which is slidably secured within a clutch mechanism which is rotationally clamped to the vertical column of the trolling motor. There are twin clutch sleeves contacted by set screws which provide drag on the handle arm when it is raised or lowered vertically which in turn rotates the clutch housing. The drag on the steering arm allows it to be held firmly within the mechanism at the desired height. This permits the steering handle arm to be operated by a person when standing, sitting or operated by foot. The clutch mechanism holds the handle arm in that position. There is no need to lock or unlock the handle arm in place in the clutch mechanism. The drag may be increased in the clutch mechanism by tightening the set screws to press on twin plastic clutch sleeves more tightly on an inner clutch shaft to set the desired drag for vibration and severe wave pounding conditions. Loosening a rotatable knob allows the arm handle to slide through the clutch mechanism thereby shortening or lengthening the arm handle to its desired length. This allows the normal hand steered motor to be guided by foot thus permitting both hands to be free for handling of rod and reel or other activities. The use of durable plastic elements, corrosion resistant metal elements and corrosion resistant screws provide a long lasting and lubrication free assembly. A soft foam handle grip provides for comfort and insulation from extreme temperature conditions.

Other advantages of the present invention, and a fuller appreciation of its mode of construction and operation, will be gained upon examination of the following detailed description of the preferred embodiments taken in conjunction with the figures of the drawings.

DETAILED DESCRIPTION OF THE PREFERRED EMBODIMENT

Figure 1:
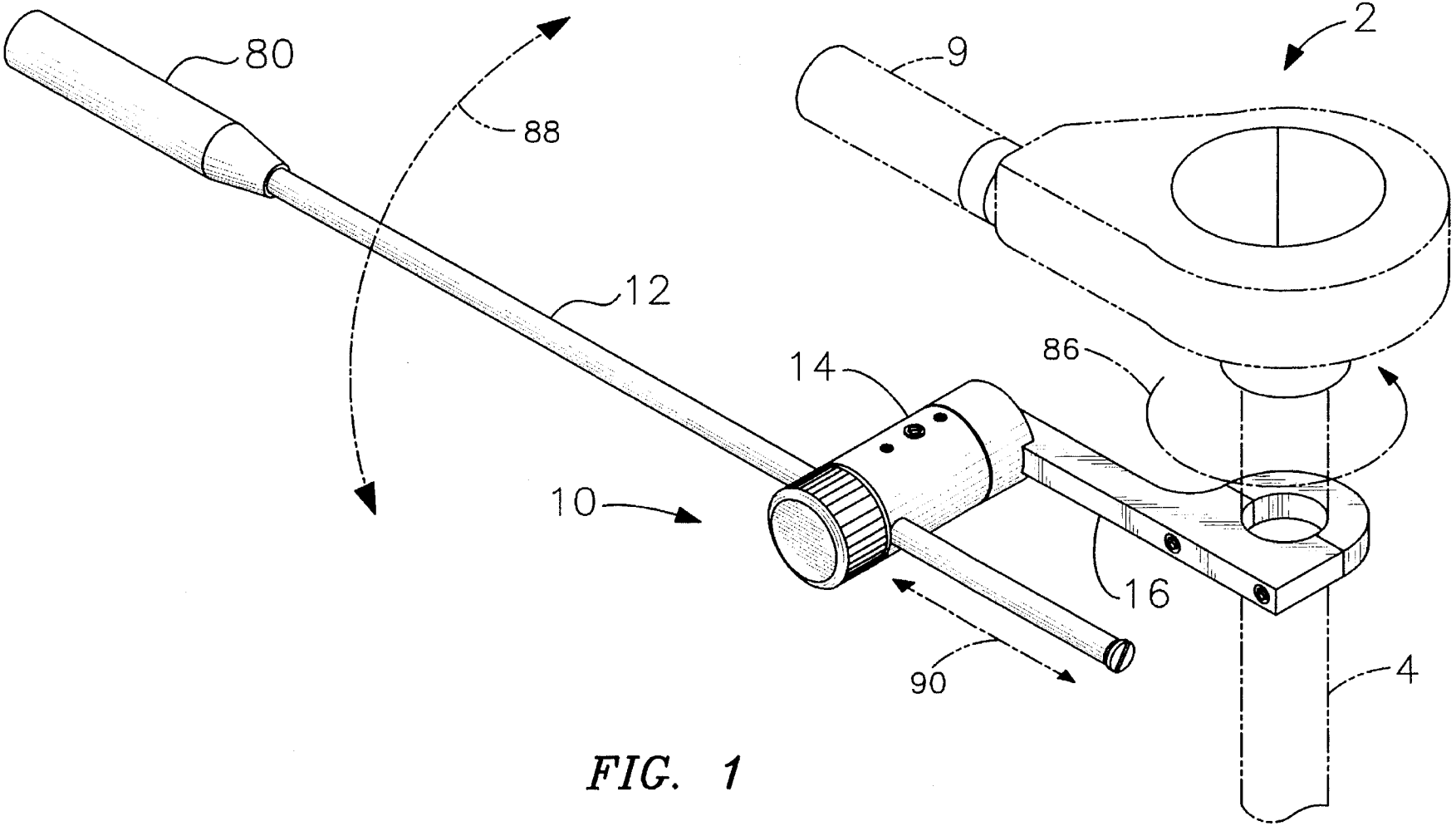
FIG. 1 is a side view showing a conventional trolling motor with the adjustable steering device of the invention mounted on the vertical column of the trolling motor.

Referring more specifically to FIG. 1, the present invention relates generally to trolling motor operated fishing boats or similar boats wherein a boat of conventional design not shown has mounted thereon an electric trolling motor 2 which may be mounted on the bow or front end of the boat. The trolling motor 2 includes a vertical column 4 generally about one inch in diameter having a submersible motor driven propeller not shown mounted at its lower end. Generally, a small handle 9 is provided at its upper end for steering the boat about its vertical axis.

The clutch controlled adjustable steering device 10 of the present invention includes an elongated steering arm 12 made of aluminium slidably mounted within near the front of clutch mechanism 14. The clutch mechanism 14 is in fixed attachment to clamp bracket 16 which in turn is rigidly attached to trolling motor vertical column 4 below small handle 9 so that the vertical column can be turned about its vertical axis in the steering of the boat.

Figure 2:
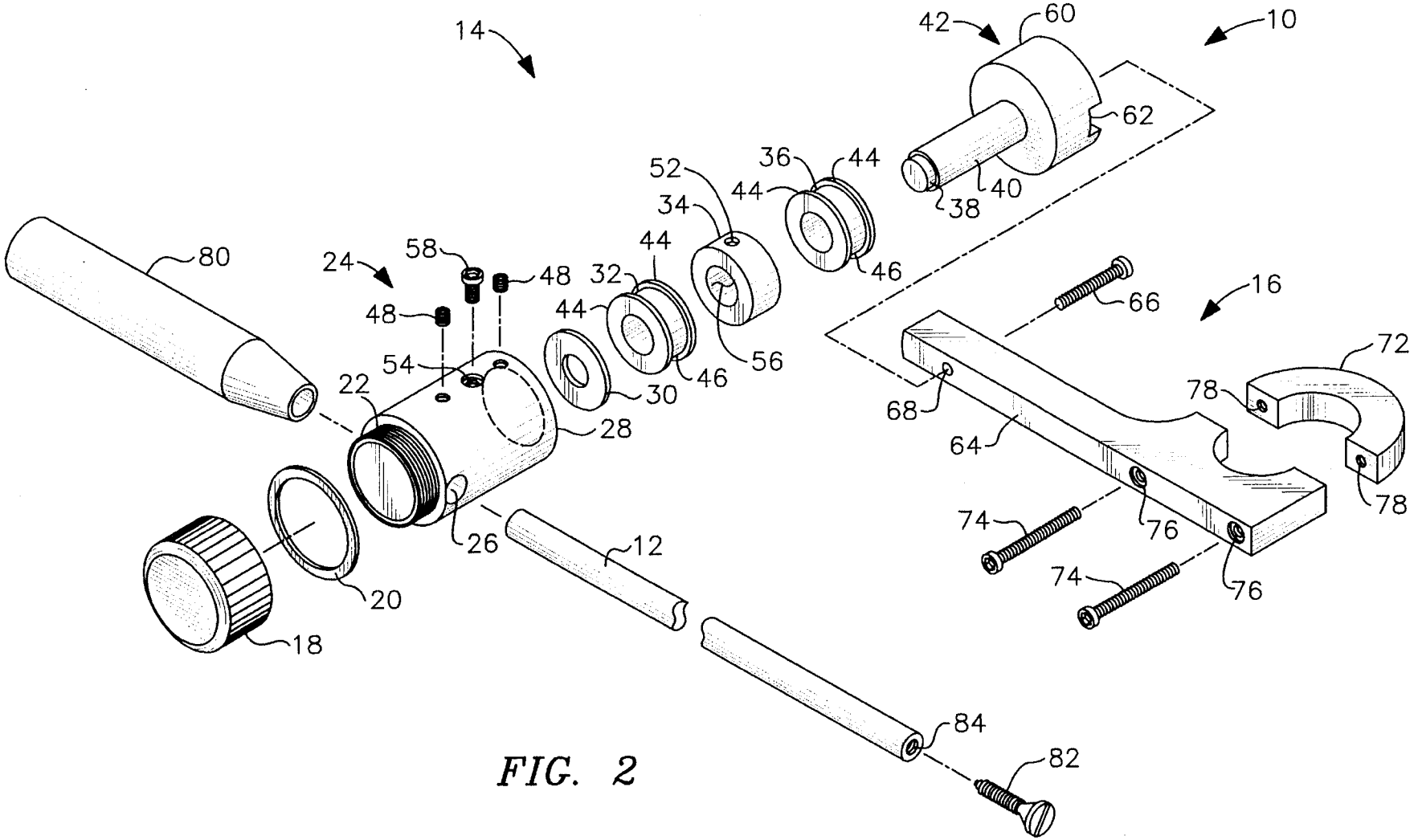
FIG. 2 is an exploded view of the adjustable steering device of the invention.

Clutch steering device 10 is shown more clearly in the exploded view seen in FIG. 2. Clutch mechanism 14 has attached at its front end a locking knob 18 made of aluminium having interior threads. Locking knob 18 is mounted on friction washer 20 on the threaded neck 22 on the closed solid front end of outer clutch housing 24 also made of aluminium shown in FIG. 3. Outer clutch housing 24 is provided with aperture 26 extending therethrough adjacent to threaded neck 22 through which steering arm 12 is slidably inserted for longitudinal movement therein. Steering arm 12 is tightened in place within the outer clutch housing by locking 18 and friction washer 20 by turning the locking knob to press against friction washer 20 made of a durable plastic, preferably delrin, whereby friction washer 20 in turn presses against steering arm 12 to rigidly hold the steering arm in place. The longitudinal lengthening and shortening of steering arm 12 is controlled by loosening the locking knob 18 and friction washer and moving the steering arm to its desired length within the interior of the boat.

Figure 4:
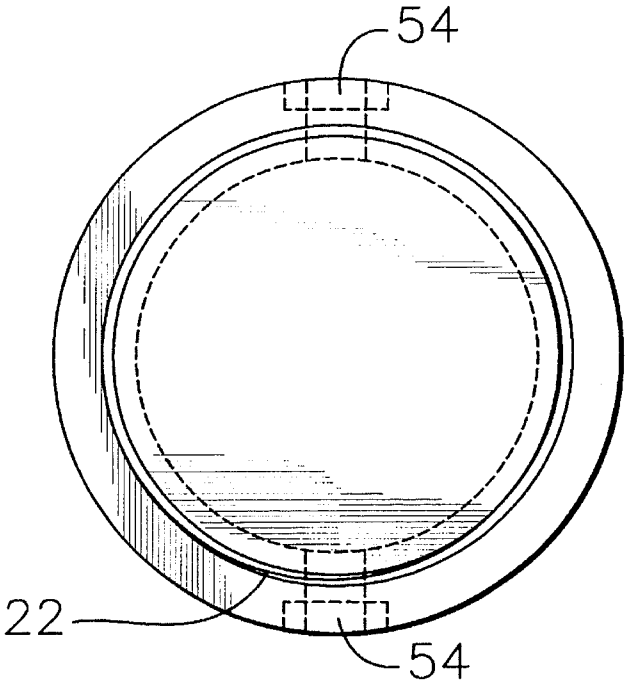
FIG. 4 is a rear end view of the outer clutch housing.
Figure 3:
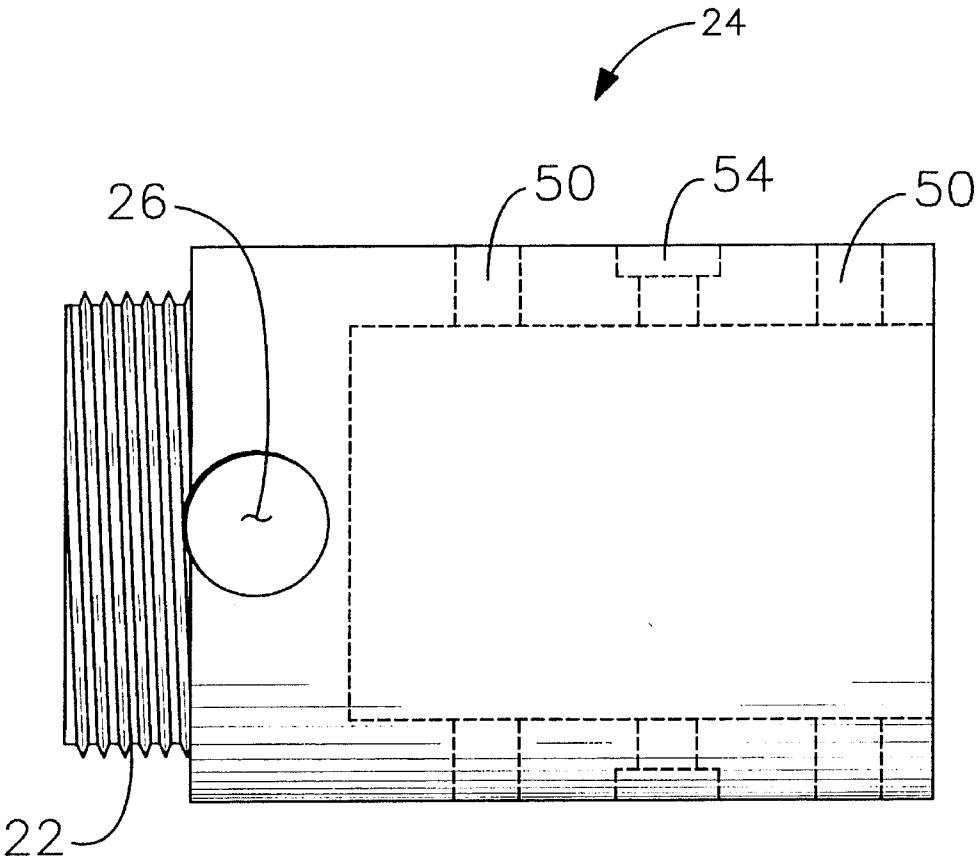
FIG. 3 is a side view of the outer clutch housing.
Figure 5:
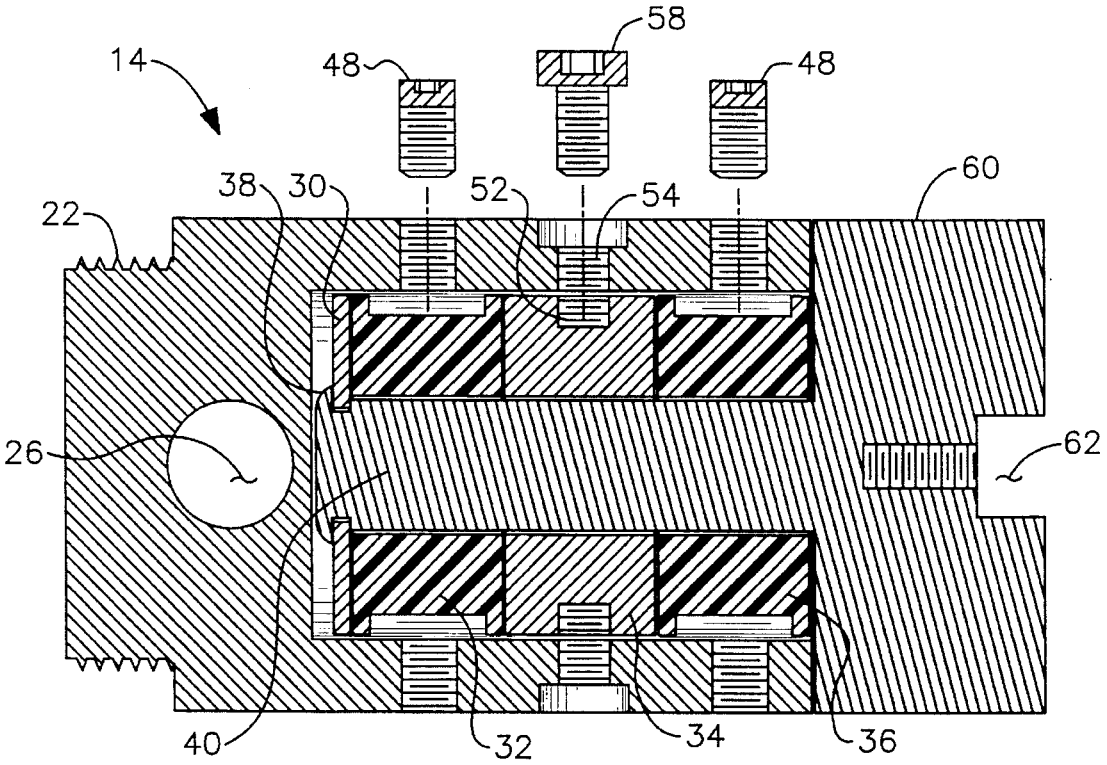
FIG. 5 is a sectional view of the clutch mechanism.

Outer clutch housing 24 as seen in FIGS. 3 and 4 is a cylindrical element closed at its threaded front end and open at its rear end forming a hollow cylindrical interior 28 therein. Sequentially housed within the hollow interior of outer clutch housing 24 are clutch end retainer 30, front clutch sleeve 32, thrust retainer sleeve 34 and rear clutch sleeve 36 which encase tip 38 and shaft 40 of inner clutch housing 42 as seen in FIG. 5.

Clutch end retainer 30 is an aluminium ring adapted to fit on tip 38 which is bent thereon to hold front clutch sleeve 32, thrust retainer sleeve 34 and rear clutch sleeve 36 securely together on shaft 40. Front and rear clutch sleeves 32 and 36 are identical durable plastic cylindrical disks, preferably made of black delrin plastic, adapted to fit tightly on each side of thrust retainer sleeve 34 on shaft 40 of inner clutch element 42. The exterior surfaces of the clutch sleeves 32 and 36 have ledges 44 extending upwardly at each end thereof having an outside diameter adapted to fit snugly and tightly within the cylindrical hollow interior 28 of the outer clutch housing. Each clutch sleeve 32 and 36 is secured in the desired location within the interior 28 of outer clutch housing 24 by two opposing spaced apart set screws 48 disposed within the tap holes 50 within the opposite side of the outer clutch housing. Preferably, two set screws are required for each clutch sleeve 32 and 36 although more or less set screws may be used if required. The set screws 48 are tightened until they exert sufficient force upon the outer interior surface 46 having a diameter slightly smaller than the diameter of ledges 44 of clutch sleeves 32 and 36. Since engaging of the set screws on the plastic surface to press against the surface of shaft 40 can irritate and roughen the outer interior surface 46, the smaller sized diameter of the outer interior surface 46 prevents contact with the clutch housing and overcomes any problems arising from the outer interior surface contacting the interior wall of the outer clutch housing. Thus, this allows the clutch sleeves 32 and 36 to be easily removed from the interior of the outer clutch housing even if the interior surface has been roughened.

As seen in FIG. 2, thrust retainer sleeve 34 is located between front clutch sleeve 32 and rear clutch sleeve 36. Thrust retainer sleeve 34 is a cylindrical disk made of aluminium having preferably two opposing spaced apart threaded holes 52, although more or less may be used if required. Threaded holes 52 are aligned with clearance holes 54 disposed within the outer clutch housing 24. Thrust retainer sleeve 34 is attached to outer clutch housing 24 by suitable screws 58, preferably Allen screws, passing through clearance holes 54 of the outer clutch housing and being threadedly secured within the aligned threaded holes 52 of the thrust retainer sleeve 34 which secures the interior elements 30, 32, 34, 36, 38 and 40 to the outer thrust housing 24. The interior diameter of axial opening 56 of thrust retainer sleeve 34 is slightly larger than the diameter of shaft 40 in order to prevent metal to metal contact between the thrust retainer sleeve 34 and shaft 40 thus eliminating any drag resulting from such a metal to metal contact in the operation of the adjustable steering device 10.

Inner clutch element 42 is made of aluminium and includes the round elongated solid shaft 40 extending longitudinally forward from a cylindrical block 60 and having a smaller diameter solid round tip 38 at its front end. As shown in FIG. 2, shaft 40 and tip 38 extend within hollow opening 28 of the outer clutch housing through the axial openings of clutch sleeves 32 and 36 and thrust retainer sleeve 34. The solid tip 38 of the shaft is then tightly secured within the axial opening of the clutch end retainer 30 which secures the inner clutch element 42 within outer clutch housing 24. Extending across the rear of cylindrical block 60 is an indented area 62 into which clamp arm 64 is inserted and attached therein by means of a flat head screw 66, such as a flat head Allen screw, fitted into central tap hole 68 and into a central tap hole in indented area 62 of cylindrical block 60.

Clamp bracket 16 which is made of aluminum includes solid clamp arm 64 and solid arcuate shaped clamp member 72. Clamp arm 64 as previously discussed is releasably attached at one end within the indented area 62 to cylindrical block 60 by means of flat head screw 66 inserted through clamp arm tap hole 68 and central tap hole in the cylindrical block. At the other end, clamp arm 64 and clamp member 72 are adapted to encircle and to be rigidly attached to vertical column 4 of the trolling motor by means of screws 74, preferably Allen screws, passing through aligned arm clamping clamp holes 76 and clamp member holes 78. Clamp bracket 16 can be attached at any position on column 4.

As seen in FIGS. 1 and 2, a soft foam handle grip 80 is provided on the front end of steering arm 12 by means of a securing means such as adhesive preferably epoxy. An oversized flat head screw 82 is inserted in the opposite end of the steering arm in tap hole 84 which prevents the steering arm from completely passing through steering arm aperture 26. The soft foam handle grip is provided for comfort and insulation from extreme temperature conditions that may be conducted along the aluminum steering arm 12, preferably a high tensile aircraft grade aluminum steering arm.

In carrying out the invention, elongated steering arm 12 with handle grip 80 attached thereto is slidably secured as indicated by arrows 90 within steering aperture 26 in outer clutch housing 24. Generally, steering arm 12 is about three feet in length. Steering arm 12 is locked in place within steering arm aperture 26 by turning locking knob 18 causing it to press against plastic friction washer 20, preferably delrin plastic, which is then forced against steering arm 12 within aperture 26 to secure the steering arm in the desired position. It will be seen that with the steering arm secured in place as described so far, a person grasping the handle grip 80 and steering arm 12 at any position to the front of the steering arm and moving the rod longitudinally will turn column 4 and the trolling motor about its vertical axis as indicated by arrow 86 and will thus steer the boat.

Steering arm 12 can now be raised or lowered vertically as indicated by arrow 88 to the desired longitudinal position desired for steering the boat. This is accomplished by moving the steering arm 12 vertically up or down which causes the outer clutch housing 24 to rotate about its longitudinal axis forcing the set screw connected thrust retainer sleeve 34 to rotate about its longitudinal axis about shaft 40 without coming in contact with the shaft surface and avoiding metal to metal contact therewith. At the same time, set screws contacted twin clutch sleeves 32 and 36 rotate and cause the clutch sleeves inner surface to press against the exterior surface of shaft 40 causing a various amount of drag on the clutch mechanism 14 due to the intensity of the tightening of the set screws pressing against the twin clutch sleeves plastic surfaces, preferably delrin plastic. The drag on the clutch mechanism, allows the steering arm to be held firmly in the desired vertical position. There is no need to lock or unlock the handle arm in place in the clutch mechanism. The drag may be increased by tightening the set screws in the twin clutch sleeves 32 and 36 to press on the plastic twin clutch sleeves more tightly against shaft 40 in order to set the desired drag to overcome and neutralize vibration and severe wave pounding conditions. Thus, the steering arm can be raised or lowered vertically to any desired position which allows the person to steer the boat by standing up, sitting down or with one's foot. The use of durable plastic twin clutch sleeves and friction washer along with corrosion resistant aluminum preferably 6061 aluminum for other elements and aluminum 2024 for the handle arm, and corrosion resistant screws preferably stainless steel screws provide a long lasting lubrication free assembly.

Generally, the overall dimensions for the steering device are: the handle arm is about 3 feet in length, the outer clutch housing is about 2 inches in length and its outside diameter is about one and three quarter inches with the central hollow interior is about one and a quarter inches in diameter, the clutch retainer ring is about 1.74 inches outside diameter having an axial opening of about 1.187 inches, locking knob 18 is about 1¾ inches outside diameter and slightly less than one inch in length, clutch sleeves 32 and 36 are about one and a quarter inch in outside diameter, about 0.85 inch axial opening, about 0.375 inch thickness and each ledge being about 0.06 inch in width, the thrust retainer sleeve 34 is about 1.25 inches outside diameter, about 0.85 inch inside diameter and about 0.365 inch in thickness, the inner clutch element is about 1.75 inches outside diameter for the block 60 and about 0.25 inch thickness, and the indented area is about 0.065 inch deep and 0.754 inch in width, shaft 40 is about 1.125 inches in length and about 0.75 inch is diameter, tip 38 is about 0.337 inch in length and 0.625 inch in diameter, clamp bracket 16 is about 5.75 inches in length and the clamp arm 64 is about 0.75 inch in width.

Obviously, many modifications and variations, as hereinbefore set forth, may be made without departing from the spirit and scope thereof, and therefore only such limitations should be imposed as are indicated in the appended claims.

What is claimed is:

1. A steering device for a trolling motor having a vertical steering column for turning the trolling motor about its vertical axis attached to the bow or stern of a boat, comprising an adjustable clutch controlled steering device having an elongated steering arm connected to a cylindrical casing encompassed clutch mechanism connected horizontally to the vertical steering column, said clutch mechanism having at least one clutch sleeve enclosed therein having an axial opening rotatably mounted on a longitudinal shaft extending therein, the arrangement being such that the vertical movement of the steering arm will rotate said clutch sleeve about said shaft causing drag on the shaft thereby positioning the steering arm at a desired vertical position, and that horizontal movement of the steering arm will turn the vertical steering column about its vertical axis to steer the boat.

2. A steering device according to claim 1 wherein there are first and second clutch sleeves rotatably mounted on said shaft.

3. A steering device according to claim 2 wherein said clutch sleeves and shaft are mounted within a cylindrical opening of the casing.

4. A steering device according to claim 3 wherein said clutch sleeves are pressed against the shaft to cause drag.

5. A steering device according to claim 4 wherein said clutch sleeves are made of plastic.

6. A steering device according to claim 5 wherein clutch sleeves are pressed against the shaft by pressure means passing through the casing.

7. A steering device according to claim 6 wherein said pressure means are screws.

8. A steering device according to claim 5 wherein a cylindrical disk having an axial opening is tightly positioned between the clutch sleeves.

9. A steering device according to claim 8 wherein said disk is secured to said casing and rotates therewith.

10. A steering device according to claim 9 wherein said disk axial opening is larger than said shaft and there is no surface to surface contact between the disk and the shaft.

11. A steering device according to claim 10 wherein said disk made is of metal.

12. A steering device according to claim 11 wherein said metal is aluminum.

13. A steering device according to claim 8 wherein a ring is tightly positioned in front of said first clutch sleeve.

14. A steering device according to claim 13 wherein said ring is tightly mounted on said shaft.

15. A steering device according to claim 13 wherein said shaft is mounted on a solid block.

16. A steering device according to claim 15 wherein said block is mounted on a clamp mounted on said column.

17. A steering device according to claim 4 wherein said elongated steering arm is adjustably and slidably mounted within said clutch mechanism.

18. A method of steering a boat having a trolling motor connected to a vertical steering column comprising mounting horizontally on said column an adjustable cylindrical casing encompassed clutch controlled steering device having at least one clutch sleeve enclosed therein rotatably mounted on a longitudinal shaft extending therein, adjustably mounting on said casing an elongated steering arm, moving said steering arm vertically to rotationally move said cylindrical casing and clutch and clutch sleeve causing drag within said clutch controlled steering device positioning the steering arm at a desired position, moving said steering arm horizontally causing said column to steer the boat.

* * * * *